United States Patent [19]

Kataoka

[11] Patent Number: 4,664,085

[45] Date of Patent: May 12, 1987

[54] AIR-FUEL RATIO CONTROL SYSTEM FOR AN AUTOMOTIVE ENGINE

[75] Inventor: Ryuji Kataoka, Mitaka, Japan

[73] Assignee: Fuji Jukogyo Kabushiki Kaisha, Tokyo, Japan

[21] Appl. No.: 813,116

[22] Filed: Dec. 24, 1985

[30] Foreign Application Priority Data

Dec. 26, 1984 [JP] Japan ..... 59-280957

[51] Int. Cl.[4] ..... F02M 51/00

[52] U.S. Cl. ..... 123/478; 123/480

[58] Field of Search ..... 123/478, 486, 488, 491, 123/480

[56] References Cited

U.S. PATENT DOCUMENTS

| | | | |
|---|---|---|---|
| 4,469,674 | 9/1984 | Takao et al. | 123/480 |
| 4,471,742 | 9/1984 | Kishi | 123/478 |
| 4,492,203 | 1/1985 | Yutaka | 123/478 |
| 4,497,301 | 2/1985 | Inoue et al. | 123/478 |
| 4,498,443 | 2/1985 | Hasagawa et al. | 123/478 |
| 4,527,529 | 7/1985 | Suzuki et al. | 123/478 |
| 4,538,578 | 9/1985 | Suzuki et al. | 123/478 |
| 4,548,178 | 10/1985 | Sato et al. | 123/478 |

*Primary Examiner*—Raymond A. Nelli

*Attorney, Agent, or Firm*—Martin A. Farber

[57] ABSTRACT

A control system is provided with a mass airflow sensor for sensing mass of intake air and for producing a mass airflow signal, an engine speed sensor for an engine speed signal proportional to the speed of the engine, and a throttle angle position sensor for producing a throttle angle signal representing the angle of the throttle valve. A first table is provided for storing first coefficients for characteristics of the injector, and a second table is provided for storing second coefficients for characteristics of the mass airflow sensor. Injection pulse width is calculated based on the mass airflow signal, engine speed signal, a read-out first coefficient and a read-out second coefficient which are dependent on the mass airflow-signal, the engine speed signal and the throttle angle signal.

6 Claims, 3 Drawing Figures

AIR-FUEL RATIO CONTROL SYSTEM FOR AN AUTOMOTIVE ENGINE

BACKGROUND OF THE INVENTION

The present invention relates to a system for controlling the air-fuel ratio for an automotive engine having a fuel injection system.

In an electronic fuel-injection control system, the amount of fuel to be injected into the engine is determined in accordance with engine operating variables such as mass air flow, engine speed and engine load. The amount of fuel is determined by a fuel injector energization time (injection pulse width). Basic injection pulse width ($T_p$) can be obtained by the following formula.

$$T_p = k \times Q/N \quad (1)$$

where Q is mass airflow, N is engine speed, and K is a constant.

Desired injection pulse width ($T_i$) is obtained by correcting the basic injection pulse width ($T_p$) with coefficients for engine operating conditions, variables, and other factors. The following is an example of a formula for computing the desired injection pulse width.

$$T_i = T_p \times \alpha \times K_{TW} \times K_{MR} \times K_{OT} \quad (2)$$

where $\alpha$ is a correcting coefficient for the output of an $O_2$-sensor provided in an exhaust passage, and $K_{TW}$ is a correcting coefficient for coolant temperature, $K_{MR}$ is a correcting coefficient for driving conditions, and $K_{OT}$ is a coefficient for other variables.

The coefficient $K_{MR}$ is provided for correcting the deviation of the air-fuel ratio from a desired ratio, which is caused by characteristics of fuel injectors. The coefficient $K_{MR}$ is stored in a three-dimensional table having an axis of calculated fuel injection pulse width (fuel injection quantity) and another axis of engine speed, divided in each address. Accordingly, the fuel injection width ($T_p$) is corrected by the coefficient $K_{MR}$ stored in the table in accordance with driving conditions.

The fuel injection pulse width (fuel injection quantity) calculated by the formula (2) increases with an increase of intake mass airflow. In a range where the fuel injection quantity is small, the fuel injection pulse width can be sufficiently corrected by the coefficient $K_{MR}$. Meanwhile, when the fuel injection quantity increases, the flow-back of the intake occurs. During closing of an intake valve of the engine. The amount of the flow-back air increases with an increase of the opening degree of the throttle valve of the engine. If a mass airflow sensor with a hot wire device is used as a mass airflow sensor, the sensor will operate to sense the flow-back mass airflow as new intake mass airflow at closing of an intake valve. The amount of the flow-back mass airflow increases with an increase of the opening degree of the throttle valve of the engine. Accordingly, the airflow sensor generates a signal representing a large mass airflow in spite of actually a small mass airflow. As a result, the calculated fuel injection pulse width is improperly increased, which causes excessive enrichment of the fuel mixture. Such a deviation of the air-fuel ratio is increased when the vehicle is driven at a high altitude, since the throttle valve is widely opened compared with a low altitude.

SUMMARY OF THE INVENTION

The object of the present invention is to provide a control system which may prevent excessive enrichment caused by flow-back of intake air at closing of the intake valves. In the system of the present invention, the effect of an airflow sensor in large fuel injection pulse width conditions is corrected by a coefficient. According to the present invention, there is provided an air-fuel ratio control system for an automotive engine having at least one fuel injector and a throttle valve. The control system comprises a mass airflow sensor for sensing the mass of intake air and for producing a mass airflow signal, an engine speed sensor for an engine speed signal proportional to the speed of the engine, and a throttle angle position sensor for producing a throttle angle signal representing the angle of the throttle valve. A first table is provided for storing first coefficients for characteristics of the injector, a second table is provided for storing second coefficients for characteristics of the mass airflow sensor. A control unit is provided for calculating an injection pulse width based on the mass airflow signal, engine speed signal, a read-out first coefficient and a read-out second coefficient which are dependent on the mass airflow signal, engine speed signal and throttle angle signal. The second coefficient is read out when the throttle angle signal is larger than a predetermined angle.

In an aspect of the present invention, the first coefficient is read out based on a basic injection pulse width which is obtained by dividing the airflow signal by the engine speed signal and on the engine speed signal, and the second coefficient is read out based on the engine speed signal and the throttle angle signal.

The other objects and features of this invention will become understood from the following description with reference to the accompanying drawings.

DETAILED DESCRIPTION OF THE PREFERRED EMBODIMENTS

Figure 1A:
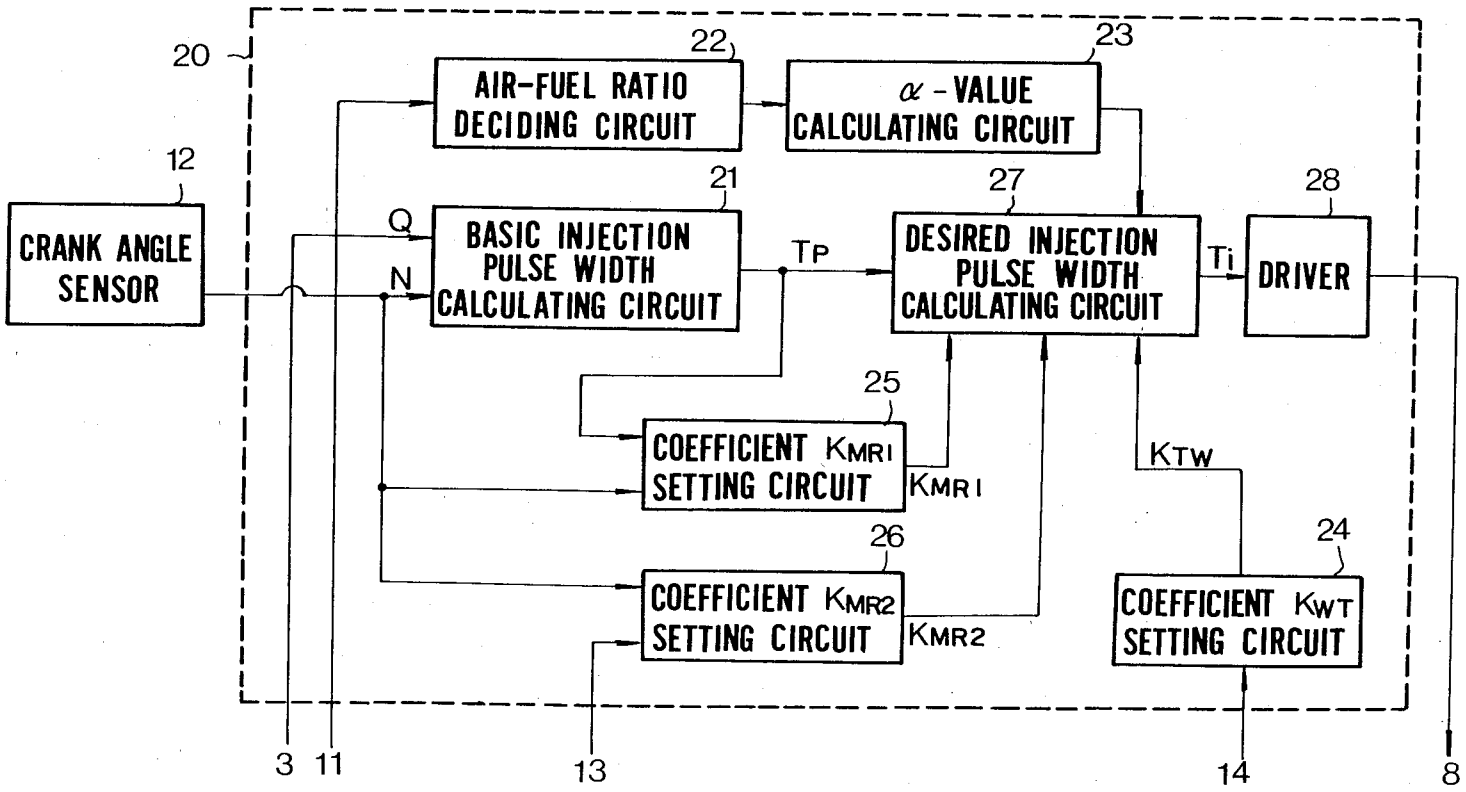
FIGS. 1*a* and 1*b* are schematic diagrams showing a control system according to the present invention.
Figure 1B:
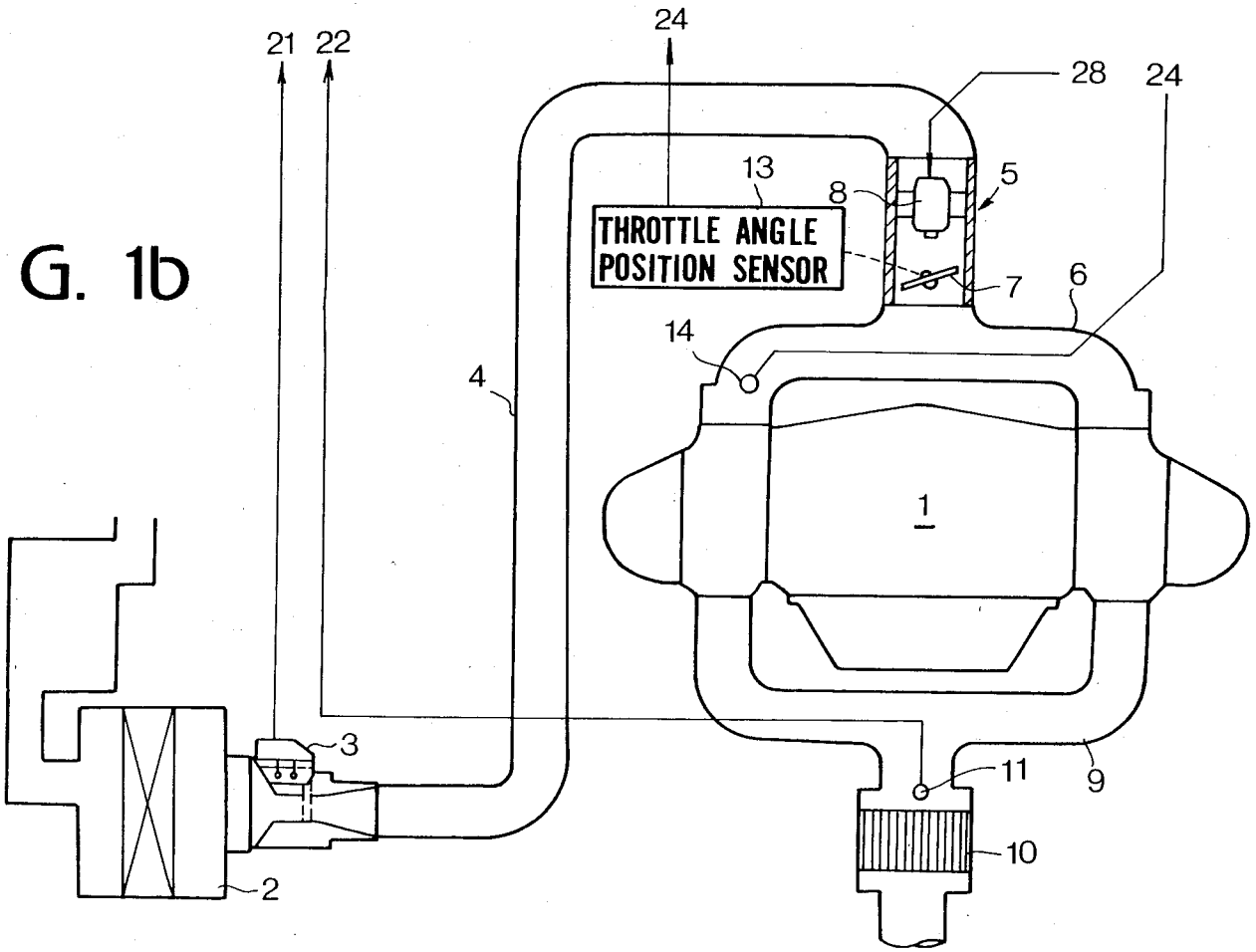

Referring to FIGS. 1*a* and 1*b*, an automotive engine 1 is provided with a mass airflow sensor 3 with a hot-wire sensing device in an intake passage 4 downstream of an air cleaner 2. In a throttle body 5 connected between the intake passage 4 and an intake manifold 6, a fuel injector 8 as a single point injector is provided upstream of a throttle valve 7. In an exhaust passage 9, an $O_2$-sensor 11 is provided upstream of a three-way catalytic converter 10.

A crank angle sensor 12 to sense engine speed, a throttle position sensor 13 for sensing the opening degree of the throttle valve 7 and a coolant temperature sensor 14 are provided on the engine. The output of the mass airflow sensor 3, which represents mass airflow Q, and the output of the crank angle sensor 12 (engine speed N) are applied to a basic injection pulse width calculating circuit 21 where the basic injection pulse width $T_p$ is calculated by the formula (1). The output of the $O_2$-sensor 11 is applied to an air-fuel ratio deciding circuit 22 which produces an output signal which is integral of the input voltage and applied to an $\alpha$-value calculating circuit 23 which produces an output $\alpha$ representing the integral. The output of the coolant temperature sensor 14 is applied to a coefficient setting circuit 24 to get the coefficient $K_{TW}$.

In accordance with the present invention, an injector related air-fuel ratio correcting coefficient $K_{MR1}$ and a mass airflow sensor related air-fuel ratio correcting coefficient $K_{MR2}$ are provided by coefficient setting circuits 25 and 26. The coefficient $K_{MR1}$ setting circuit 25 is applied with an engine speed signal (N) from the crank angle sensor 12 and the basic injection pulse width signal ($T_p$) from the circuit 21 to produce the injector related correcting coefficient $K_{MR1}$. The circuit 25 has a three-dimensional table having axes representing $T_p$ and N, in which a plurality of coefficients $K_{MR1}$ are stored so as to correct the deviation of air-fuel ratio from a desired ratio, which is caused by the injector characteristic in a range of small injection pulse width $T_p$.

On the other hand, the coefficient $K_{MR2}$ setting circuit 26 is applied with the engine speed signal (N) and a throttle angle signal ($\theta$) from the throttle angle position sensor 13 to produce the mass airflow sensor related air-fuel ratio coefficient $K_{MR2}$. The circuit 26 has a three-dimensional table with axes of signals N and $\theta$ where a plurality of coefficients $K_{MR2}$ are stored so as to correct the sensor effect in a range of wide throttle opening greater than a predetermined angle $\theta_1$.

Signals $\alpha$, $T_p$, $K_{TW}$, $K_{MR1}$ and $K_{MR2}$ are applied to a desired injection pulse width calculating circuit 27 which calculates the pulse width ($T_i$) by the formula (2). The pulse width signal ($T_i$) is applied to a driver 28 which operates to drive the fuel injector 8.

Figure 2:
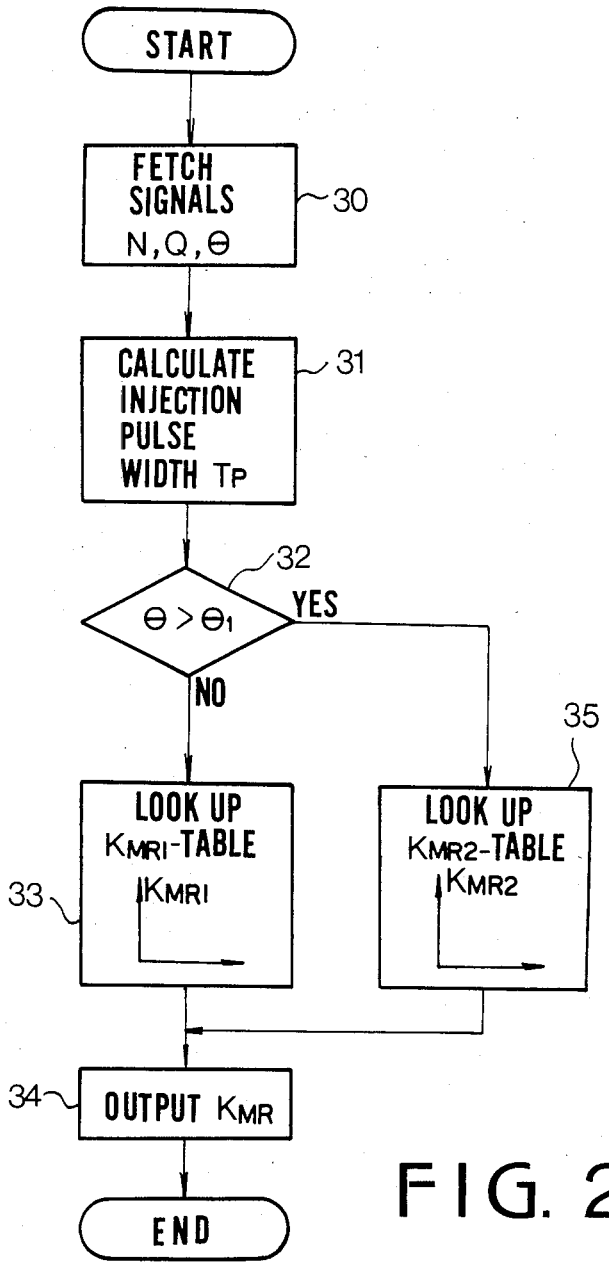
FIG. 2 is a flowchart showing the operation of the control system.

Referring to FIG. 2, at step 30, data N, Q and $\theta$ are fetched, and the injection pulse width $T_p$ is calculated based on N and Q at a step 31. Thereafter, it is determined whether the throttle angle $\theta$ is larger than the predetermined angle $\theta_1$ at a step 32. When the angle $\theta$ is smaller than angle $\theta_1$, the coefficient $K_{MR1}$ is read out from the corresponding $K_{MR1}$-table at a step 33, and a proper coefficient $K_{MR1}$ is produced at a step 34, so that in a small throttle angle range the desired fuel injection pulse width is corrected. When the angle $\theta$ is larger than $\theta_1$, a coefficient $K_{MR2}$ is read out from the corresponding $K_{MR2}$-table at a step 35. Thus, the deviation of the air-fuel ratio caused by the effect of the mass airflow sensor in a wide throttle open range is corrected by the coefficient $K_{MR2}$, and the desired injection pulse width $T_i$ is calculated. Thus, excessive enrichment caused by the flow-back of intake air can be prevented.

In another embodiment of the present invention, the following calculation is performed.

$$K_{MR}=K_{MR1}+K_{MR2}$$

Namely read-out data $K_{MR1}$ and $K_{MR2}$ are added and the combined coefficient $K_{MR}$ is always used as a coefficient without determining the magnitude of the of throttle angle $\theta$ with respect to the angle $\theta_1$. Accordingly, the combined coefficient is always used to calculate the desired injection pulse width $T_i$.

While the presently preferred embodiments of the present invention has been shown and described, it is to be understood that this disclosure is for the purpose of illustration and that various changes and modifications may be made without departing from the scope of the invention as set forth in the appended claims.

What is claimed is:

1. An air-fuel ratio control system for an automotive engine having at least one fuel injector operating by an injection pulse and a throttle valve, the system comprising:

a mass airflow sensor for sensing mass of intake air and for producing a mass airflow signal;

an engine speed sensor for producing an engine speed signal proportional to the speed of the engine;

a throttle angle position sensor for producing a throttle angle signal representing the angle of the throttle valve;

a first table storing first coefficients for correcting deviation of air-fuel ratio which is caused by characteristics of the injector;

a second table storing second coefficients for correcting deviation of the air-fuel ratio which is caused by characteristics of the mass airflow sensor for flow-back air;

means for calculating the injection pulse width based on the mass airflow signal, engine speed signal, a read-out first coefficient and a read-out second coefficient respectively, said coefficients being dependent on the mass airflow signal, engine speed signal and throttle angle signal.

2. An air-fuel ratio control system according to claim 1, wherein said means calculates said injection pulse width by using said first and second coefficients at any angle of the throttle valve.

3. An air-fuel ratio control system according to claim 2, wherein said means calculates said injection pulse width by adding said first and second coefficients.

4. An air-fuel ratio control system according to claim 1, wherein said means calculates said injection pulse width by using said first coefficient but not said second coefficient when the angle of the throttle valve is less than a predetermined value, and respectively, by using said second coefficient but not said first coefficient when the angle of the throttle valve is greater than said predetermined value.

5. The air-fuel ratio control system according to claim 1 wherein the second coefficient is read out when the throttle angle signal is larger than a predetermined angle.

6. The air-fuel ratio control system according to claim 1 wherein the first coefficient is read out based on a basic injection pulse width which is obtained by dividing the airflow signal with the engine speed signal and on the engine speed signal, and the second coefficient is read out based on the engine speed signal and throttle angle signal.

* * * * *